US009193196B1

(12) United States Patent
Meyer et al.

(10) Patent No.: US 9,193,196 B1
(45) Date of Patent: Nov. 24, 2015

(54) PRINTER HEAD SHUTTLE AND PRINTER HEAD ASSEMBLY SYSTEMS

(71) Applicants: Daniel B. Meyer, Lake Oswego, OR (US); Robert W. Martell, Portland, OR (US); Stacy Foos, Milwaukie, OR (US); Jian-Hua Chen, New Taipei (TW); Tsan-Fang Yu, New Taipei (TW); Feng-Yi Tai, New Taipei (TW)

(72) Inventors: Daniel B. Meyer, Lake Oswego, OR (US); Robert W. Martell, Portland, OR (US); Stacy Foos, Milwaukie, OR (US); Jian-Hua Chen, New Taipei (TW); Tsan-Fang Yu, New Taipei (TW); Feng-Yi Tai, New Taipei (TW)

( * ) Notice: Subject to any disclaimer, the term of this patent is extended or adjusted under 35 U.S.C. 154(b) by 0 days.

(21) Appl. No.: 14/539,489

(22) Filed: Nov. 12, 2014

(51) Int. Cl.

| | |
|---|---|
| ***B41J 29/00*** | (2006.01) |
| ***B41J 25/308*** | (2006.01) |
| ***B41J 2/01*** | (2006.01) |
| ***B41J 25/34*** | (2006.01) |

(52) U.S. Cl.
CPC ..... *B41J 25/34* (2013.01)

(58) Field of Classification Search
USPC ..... 347/8, 37, 101, 104
See application file for complete search history.

(56) References Cited

U.S. PATENT DOCUMENTS

| | | | | |
|---|---|---|---|---|
| 5,065,169 | A * | 11/1991 | Vincent et al. | 347/8 |
| 5,808,647 | A * | 9/1998 | Kurata et al. | 347/104 |
| 6,550,907 | B2 * | 4/2003 | Uchida | 347/104 |

* cited by examiner

*Primary Examiner* — Jason Uhlenhake
(74) *Attorney, Agent, or Firm* — Mohr Intellectual Property Law Solutions, PC

(57) ABSTRACT

Printer head shuttles configured to control contact pressure of one or more printer head assemblies against a printing substrate and an underlying platen during a printer operation are shown and described. The printer head shuttles include a shuttle guide and a shuttle main body having one or more printer head assemblies. Each printer head assembly includes an axel attached to the shuttle main body, an assembly main body pivotably attached to the axel, a mounting plate attached to the assembly main body, a printer head attached to the mounting plate, and a drive mechanism for pivoting the head assembly between a substrate compressing position and a substrate non-compressing position.

20 Claims, 13 Drawing Sheets

PRINTER HEAD SHUTTLE AND PRINTER HEAD ASSEMBLY SYSTEMS

BACKGROUND

The present disclosure relates generally to printer head shuttle and printer head assemblies for supporting and operating a printer head. In particular, printer head shuttles and printer head assemblies configured to control contact pressure of printer head assemblies against a printing substrate are described.

Printers (e.g., thermal printers, toner-based printers, liquid inkjet printers, solid ink printers, dye-sublimation printers, etc.) are peripheral computer devices that are used to create a printed graphic or text on a printing substrate (e.g., paper, plastic sheets, etc.). In general, a printer includes a printer head for transfer of the printed graphic or text on the substrate. Position and/or operation of the printer head is controlled by a printer head assembly and a printer head shuttle, which move the printer head across the printing substrate.

Known printer head shuttles and printer head assemblies are not entirely satisfactory for the range of applications in which they are employed. In one example, existing printer head shuttles and printer head assemblies can propagate "waves" in the printing substrate as they move across the substrate surface. In other words, a small fold may form in the substrate and the printer head shuttle and/or printer head assembly may sustain and/or increase the fold across the substrate causing a blank space on the final printed surface.

In another example, conventional printer head shuttles and printer head assemblies provide uneven pressure of the printer head on the substrate, causing uneven coloration (i.e., saturation) in the printed graphic and/or text. Additionally, known printer head shuttles and printer head assemblies have high power requirements that are often subject to overheating, which can cause misprinting.

Thus, there exists a need for printer head shuttles and printer head assemblies that improve upon and advance the design of known printer head shuttles and printer head assemblies. Examples of new and useful printer head shuttle and printer head assemblies relevant to the needs existing in the field are discussed below.

Disclosure addressing one or more of the identified existing needs is provided in the detailed description below. Examples of references relevant to printer head shuttles and printer head assemblies include U.S. Patent Reference: patent publication 20020033874. The complete disclosures of the above patent application is herein incorporated by reference for all purposes.

SUMMARY

The present disclosure is directed to printer head shuttles configured to control contact pressure of one or more printer head assemblies against a printing substrate and an underlying platen during a printer operation. The printer head shuttles include a shuttle guide and a shuttle main body, configured for backward and forward movement across the shuttle guide, the shuttle main body having one or more printer head assemblies. Each printer head assembly includes an axel attached to the shuttle main body, an assembly main body pivotably attached to the axel, a mounting plate attached to the assembly main body, a printer head attached to the mounting plate, and a drive mechanism for pivoting the head assembly between a substrate compressing position and a substrate non-compressing position. The assembly main body is configured to provide at least a first compressing force on the printing substrate and the underlying platen when the at least one printer head assembly is in the substrate compressing position. In some examples, the mounting plate provides a second compressing force on the printing substrate. In some examples, a print head cartridge cover provides a third compressing force on the printing substrate.

DETAILED DESCRIPTION

Figure 1:
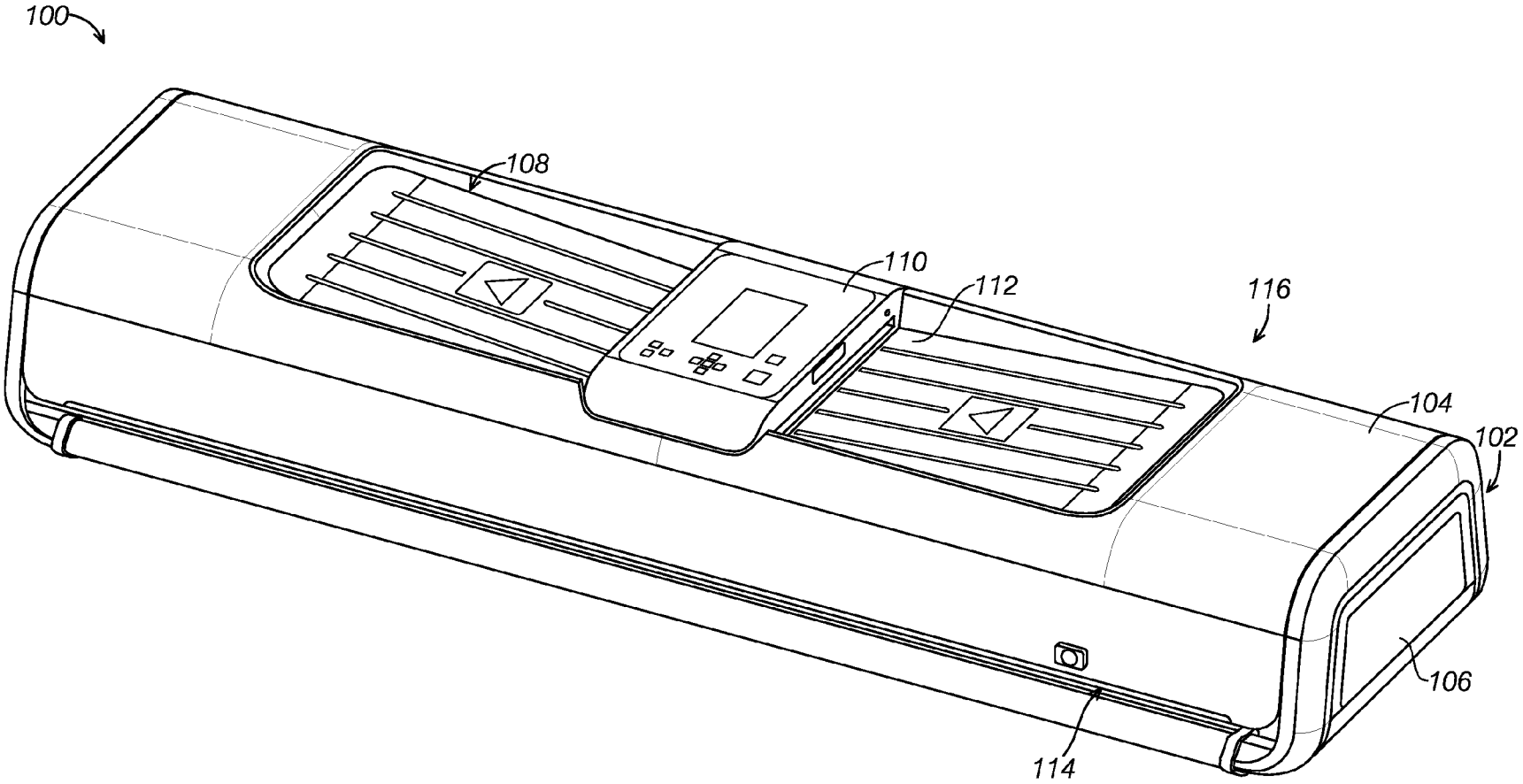
FIG. 1 is a perspective view of a first example printer in a closed position.

The disclosed printer head shuttle and printer head assemblies will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various printer head shuttle and printer head assemblies are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

With reference to FIGS. 1-12B, a first example of a printing system, printing system 100, will now be described. Printing system 100 includes a printer main body 102 for housing a printer head shuttle system 200 having two printer head assemblies 300 (i.e., 300*a* and 300*b*) and a printable substrate 122. Printing system 100 functions to transfer or otherwise print a graphic and/or text image onto the printing substrate in a printing operation, while providing a first compressing force on the printing substrate. Additionally or alternatively, printing system 100 can be used to provide a second and/or third compressing force on the printing substrate during the printing operation. Each of the first, the second, and the third compressible forces can have an adjustable pressure. Further, additionally or alternatively, printing system 100 can be used for alternating operation of printer head assemblies 300 (i.e., 300*a* and 300*b*) during a printing operation.

Printing system 100 addresses many of the shortcomings existing with conventional printing systems. For example, one or more of the compressive forces can prevent the formation of folds in the printing substrate during a printing operation. In another example, a stable pressure can be applied on the printing substrate during a printing operation so that the printed graphic and/or text can have a substantially even a coloration, saturation, and/or tone. In even another example, printing system 100 can have lower power requirements and thereby be resistant to overheating and/or misprinting caused by overheating.

Figure 2:
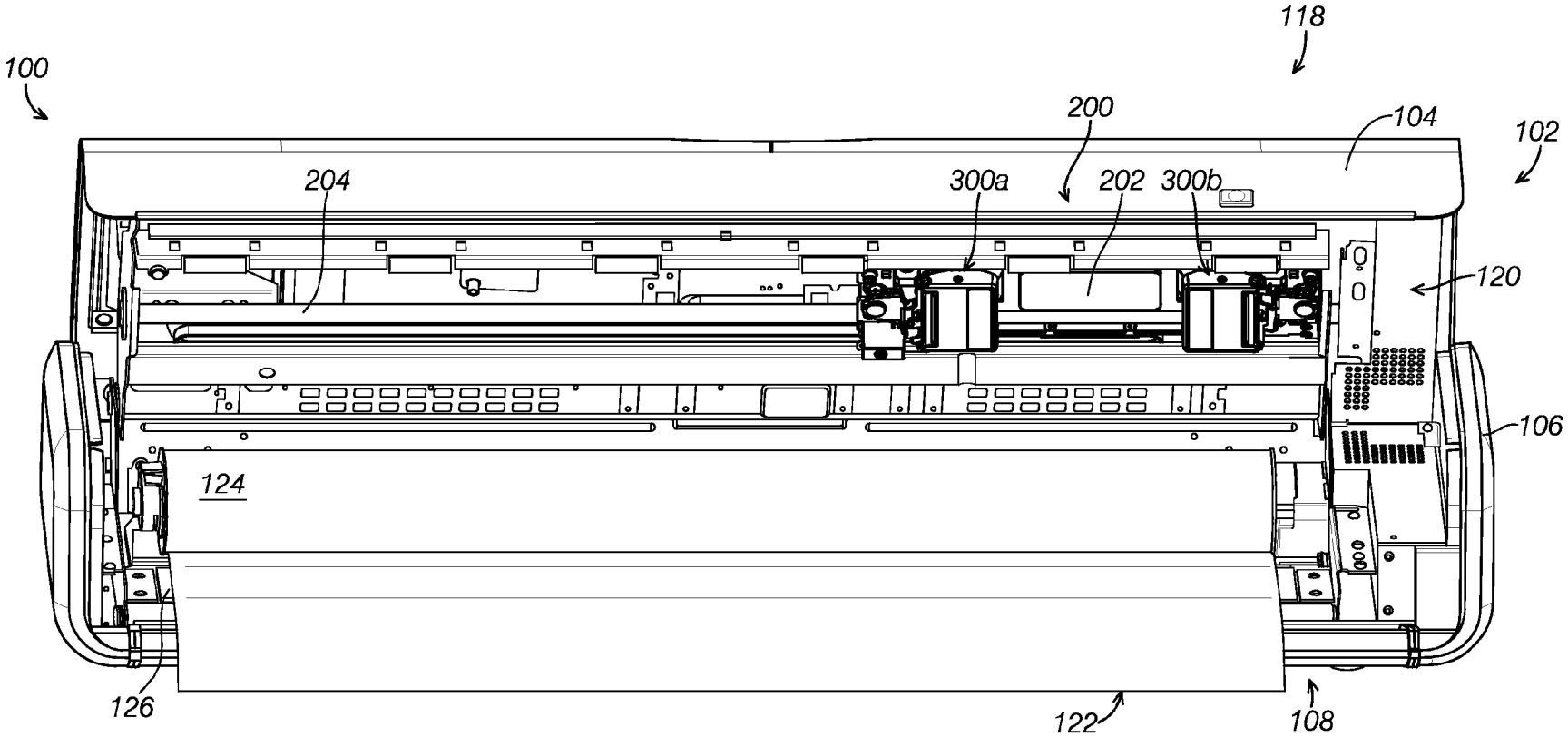
FIG. 2 is a front elevation view of the first example printer in an open position.
Figure 3:
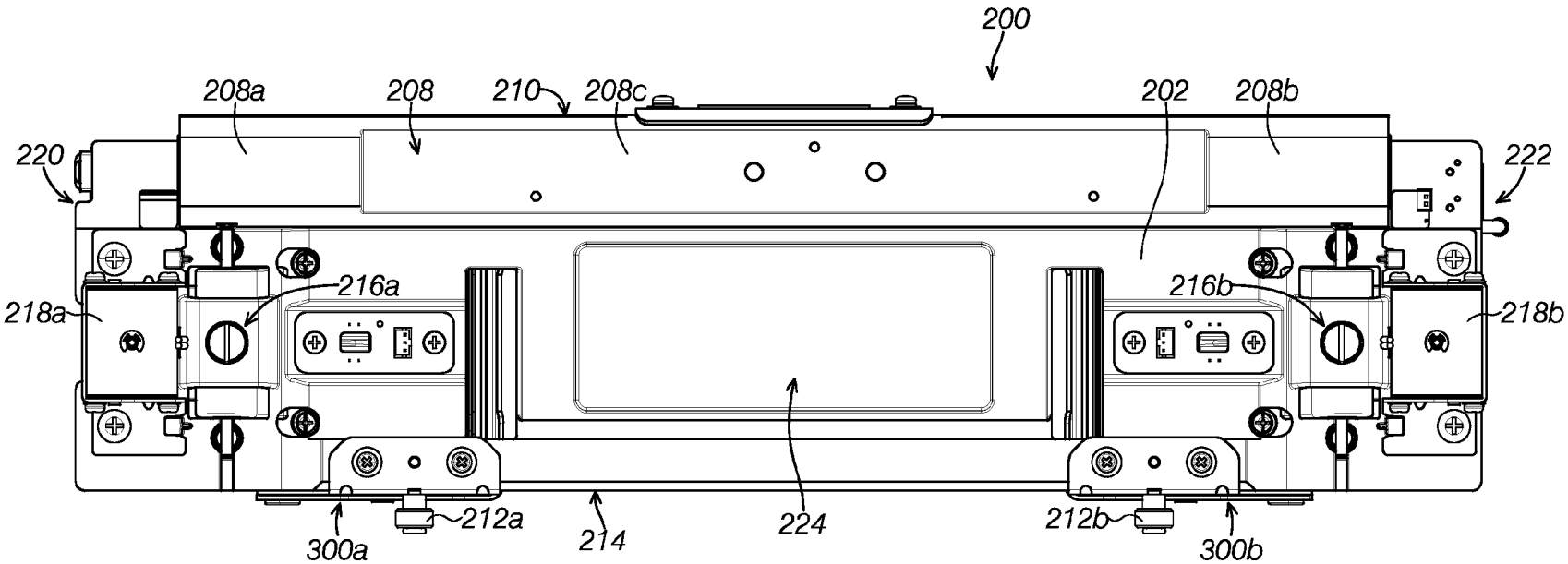
FIG. 3 is a top plan view of a first example printer head shuttle for the first example printer shown in FIGS. 1 and 2.
Figure 4:
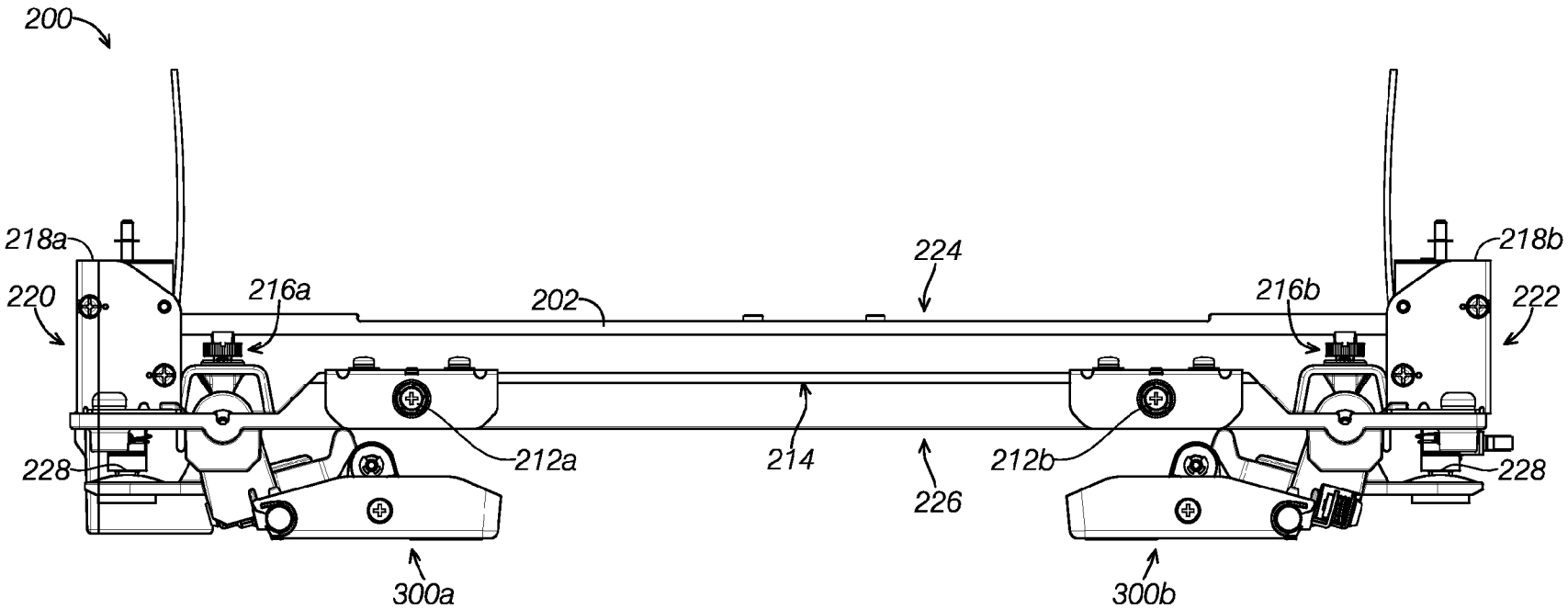
FIG. 4 is a side elevation view of the first example printer head shuttle shown in FIG. 3.
Figure 5:
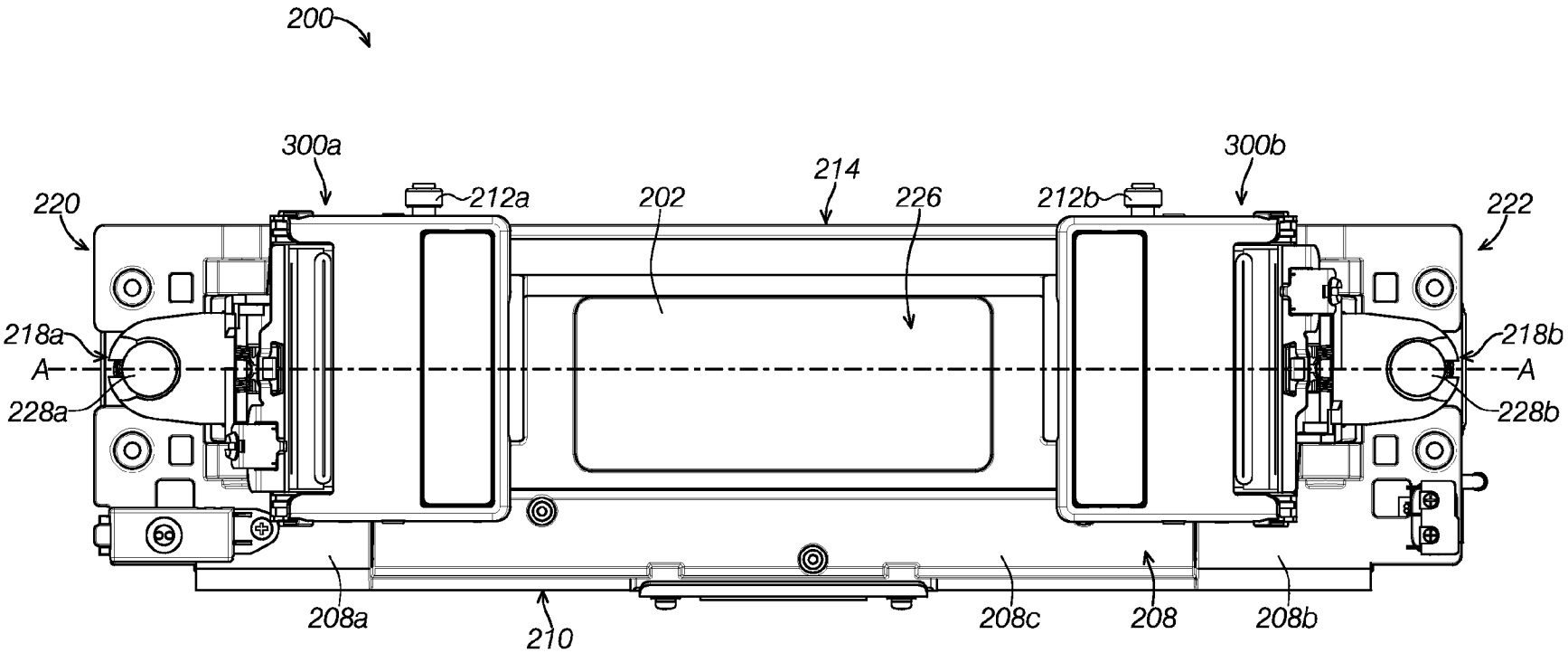
FIG. 5 is a bottom plan view of the first example printer head shuttle shown in FIG. 3.

As can be seen in FIGS. 1 and 2, printer main body 102 includes a printer lid 104 that is selectively rotatable to cover a printer base 106. An exterior surface 108 of printer lid 104 includes a control panel 110 and a master paper tray 112. A feed space 114 between lip edges of lid 104 and base 106 is a substrate feed for printing substrate 122.

In FIG. 1, lid 104 is in a closed position 116, while FIG. 2 depicts lid 104 in an open position 118. It will be appreciated that the lid is selectively pivotable between the closed position and the open position via a pivotable attachment mechanism (not specifically shown). As shown in FIG. 2, an interior surface 120 of lid 104 includes a printer head shuttle system 200 having a shuttle main body 202 that is moveable along a shuttle guide 204. Printer head assemblies 300*a* and 300*b* are pivotably attached to opposing longitudinal ends of the shuttle main body. Further, a roll 124 of printing substrate 122 is located inside printer main body 102 and is supported on a platen 126 as it is unrolled during a printing operation.

The shuttle main body is configured for backward and forward movement across the shuttle guide. During a printing operation, the lid is in the closed position and the printer head shuttle moves forward and backward along the shuttle guide. The printer head assemblies are proximal to and/or contact the printing substrate and move across the surface of the printing substrate as the shuttle guide moves forward and backward along the shuttle guide. The printing substrate is incrementally fed through the feed space as it is printed upon and the printing substrate is supported by the platen.

FIGS. 3-6 show detailed views of printer head shuttle system 200. As depicted in FIGS. 3-6, shuttle main body 202 includes a guide sleeve 208 (having encompassing sleeve portions 208*a* and 208*b* on opposing ends and a central partially encompassing portion 208*c*) on a first lateral side 210 of the shuttle main body, shuttle roller supports 212*a* and 212*b* on a second lateral side 214 of the shuttle main body. In the present example, the guide sleeve is continuous with the shuttle main body is configured to encompass the shuttle guide in order to moveably couple the shuttle main body to the shuttle guide. Further, in the present example, shuttle roller supports are attached via fastening members and function to support the second lateral side of the shuttle main body.

In alternate examples, the guide sleeve can be discontinuous with the shuttle main body (e.g., be a separate piece attached via attachment members) and/or the shuttle roller supports can be continuous with the shuttle main body. In other alternate embodiments, the shuttle main body can have a different configuration and/or be moveable via a different mechanism. For example, the shuttle main body can be attached to a robotic arm for moving the printer head shuttle forward and backward or side to side across the printing substrate surface. In even other alternate embodiments, the printer head shuttle can include more or fewer printer head assemblies.

Also shown in FIGS. 3-6, shuttle main body 202 further includes printer head assembly attachment mechanisms 216*a* and 216*b*, printer head assembly drive mechanisms 218*a* and 218*b*, and printer head assemblies 300*a* and 300*b* located on opposing longitudinal ends of the shuttle main body (i.e., ends 220 and 222, respectively). Printer head assembly attachment mechanisms 216*a* and 216*b* are located on an upper surface 224 if the shuttle main body, while printer head assemblies 300*a* and 300*b* are located on a lower surface 226 of the shuttle main body. Printer head assembly drive mechanisms 218*a* and 218*b* are substantially located on upper surface 224 and each include a moveable arm (i.e., moveable arms 228*a* and 228*b*, respectively) that is extended to lower surface 226 for operative coupling to printer head assemblies 300*a* and 300*b*.

Figure 7:
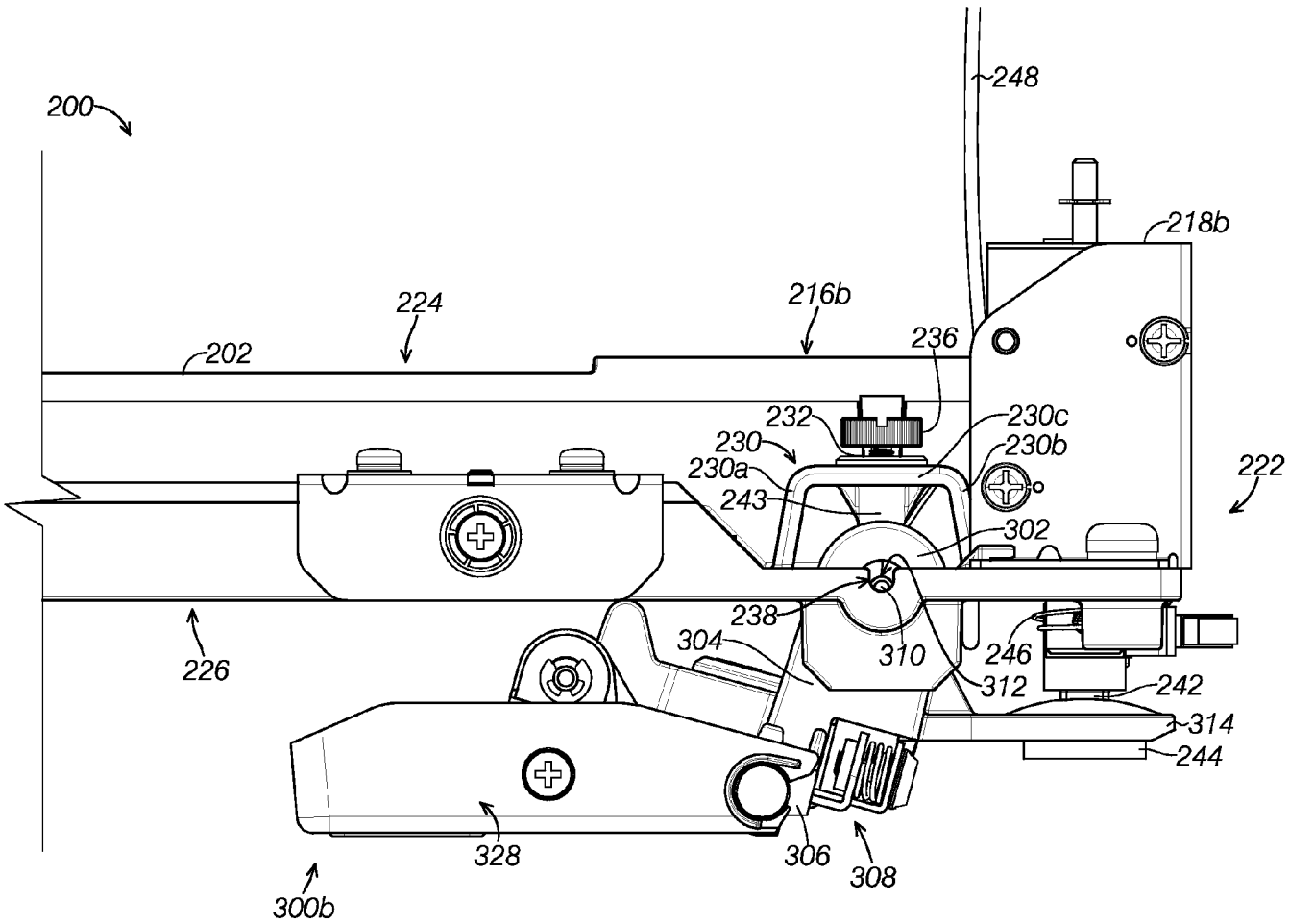
FIG. 7 is a side elevation view of a first example printer head assembly of the printer head shuttle shown in FIG. 3.

FIG. 7 shows a detailed view of attachment mechanism 216*b*, drive mechanism 218*b*, and printer head assembly 300*b*. Specifically, coupling between the attachment mechanism and the printer head assembly and coupling between the drive mechanism and the printer head assembly are shown and described. It will be appreciated that although only attachment mechanism 216*b*, drive mechanism 216*b*, and printer head assembly 300*b* are shown and described in detail, attachment mechanism 216*a*, drive mechanism 218*a*, and printer head assembly 300*a* have a substantially identical configuration.

Figure 8:
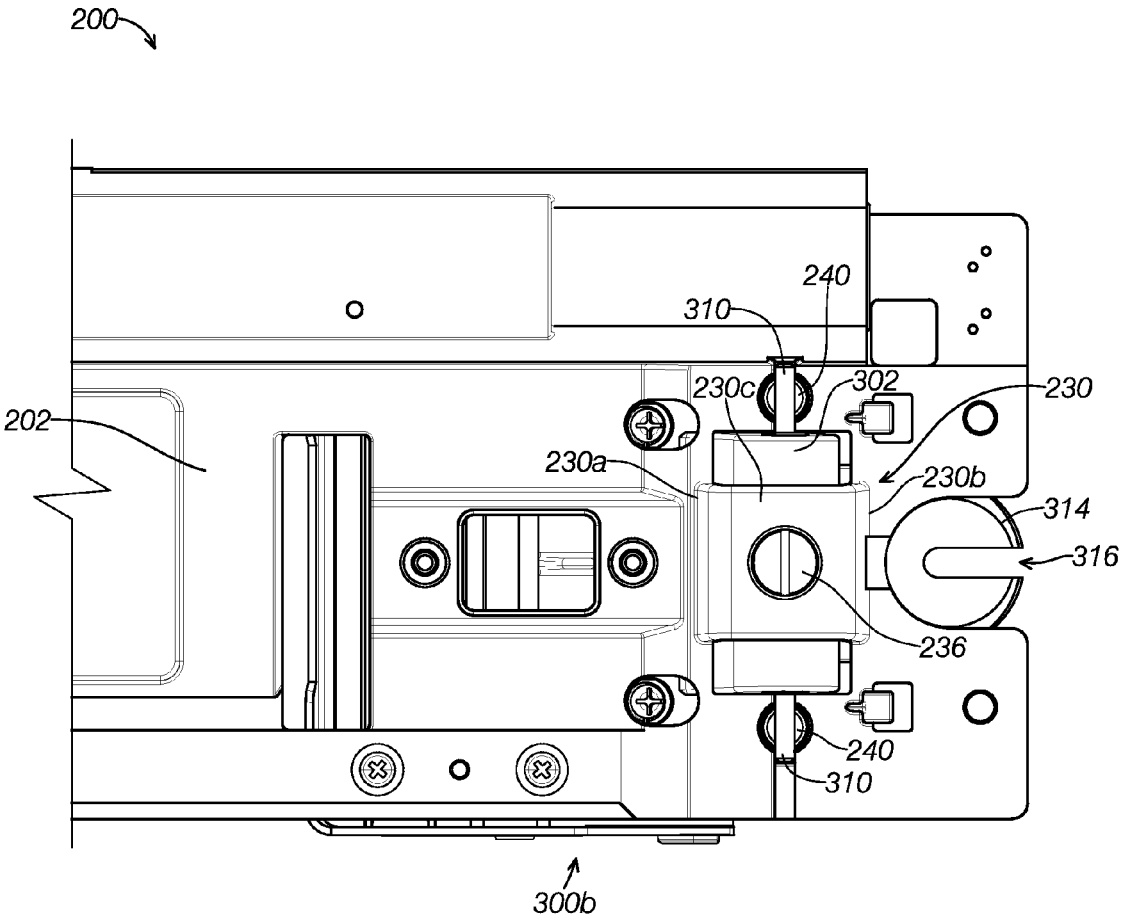
FIG. 8 is a top plan view of the first example printer head assembly shown in FIG. 7.

As depicted in FIGS. 7 and 8, attachment mechanism 216*a* includes a bridge 230 having side walls 230*a* and 230*b* and top wall 230*c*. Top wall 230*c* has a central hole 232 that is extended downwardly from top wall 230*c* through a cylindrical shaft 243. A threaded fastening member 236 (e.g., a set screw) is selectively insertable and tightenable through central hole 232, central hole 232 being complimentarily configured to fastening member 236. A bottom end of fastening member 236 (shown in FIG. 6) is extended through a central channel (central channel 322 shown in FIG. 11) of a rounded top end 302 of a printer head assembly vertical wall 304. Further, the bottom end of fastening member 236 is abuttable to a top surface of an axel 310.

Vertical wall 304 and a printer head assembly horizontal plate 306 substantially comprise a printer head assembly main body 308. Axel 310 is extended through a lateral hole 312 in rounded top end 302. Assembly main body 308 is pivotably attached to the axel. Opposing ends of axel 310 are configured to be retained within an axel receiving groove 238 in shuttle main body 202 in order to mount the axel to the shuttle main body. Each of end of axel 310 is mounted on one of a pair of springs 240 (shown in the exploded view of FIG. 6). Pair of springs 240 contact axel 310 on an opposing side (i.e., a bottom side) of the axel relative to the bottom end of fastening member 236.

Figure 9A:
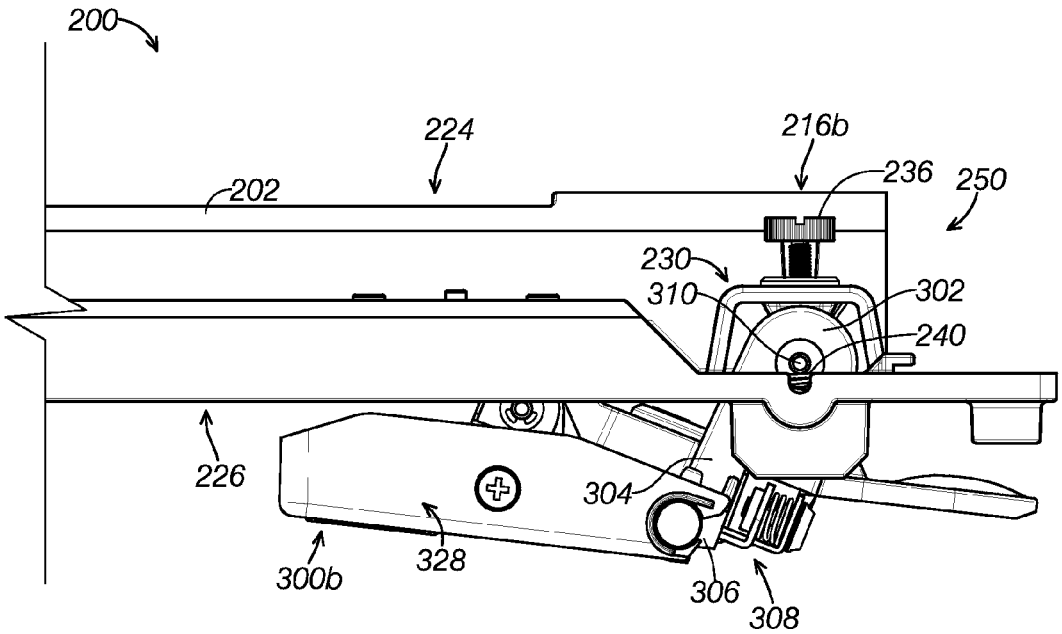
FIGS. 9A and 9B are side elevation views of an example attachment mechanism in a loosened position and in a tightened position, respectively, for the first example printer head assembly shown in FIG. 7.
Figure 9B:
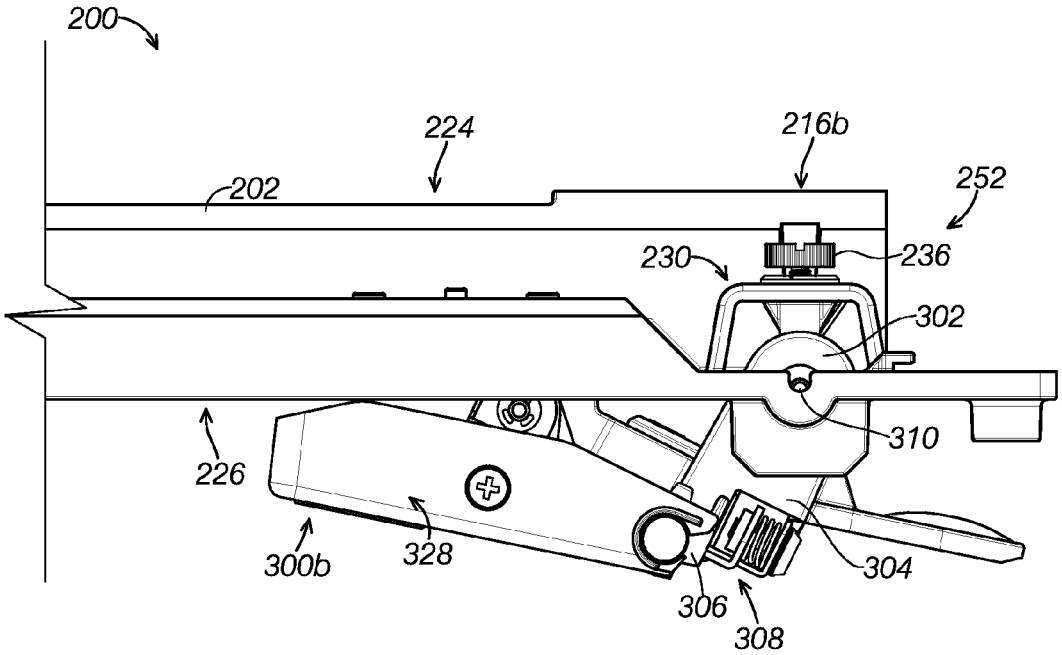

As depicted in FIGS. 9A and 9B, fastening member 236 is selectively moveable between a loosened position 250 and a tightened position 252. In loosened position 250 shown in FIG. 9A, fastening member 236 is in a raised position and pair of springs 240 (only one shown) are in an extended position. Accordingly, printer head assembly main body 308 is also in a generally raised position in loosened position 242. Further, printer head assembly main body 308 is disposed at a smaller approach angle (i.e., inclined to a lesser degree relative to the platen and/or the printing substrate). Furthermore, in this position, the axel (and the printer head assembly main body attached thereto) are configured to be more tiltable around a longitudinal axis A-A (shown in FIG. 5) of the shuttle main body 202 by alternate compression of one of pair of springs 240.

In tightened position 252 shown in FIG. 9B, fastening member 236 is in a lowered position and pair of springs 240 (not visible) are both in a compressed position. Accordingly, printer head assembly main body 308 is also in a generally lowered position in tightened position 252. Further, printer head assembly main body 308 is disposed at a greater approach angle (i.e., inclined to a greater degree relative to the platen and/or the printing substrate). Furthermore, in this position, the springs provide an upward force on the bottom axel, while the tightened fastening member provides a downward force on the top of the axel. Thus, the axel (and the printer head assembly main body attached thereto) are less tiltable around the longitudinal axis A-A.

In alternate examples, the fastening member can be in an intermediate position. It will be appreciated that the fastening member can be adjusted for a desired amount of pressure on the axel and/or allowance of tilt of a printer head assembly around a longitudinal axis of the shuttle main body. In general, the springs, axel, and fastening member are a "balance feature" to assist in allowing a printer head assembly to have constant contact and even pressure with the printing substrate against the platen during use in a printing operation. Adjustment of the fastening member can adjust the fulcrum position of the associated printer head assembly and the printer head assembly edge contact pressure on the printing substrate and the platen. In even other alternate examples, one or more of the printer head assemblies can be attached to the shuttle main body via a different mechanism that is stationary or adjustable.

Returning to FIG. 7, drive mechanism 218*b* is coupled to top surface 226 of shuttle main body 202 and an attachment plate 314, which is extended outwardly from assembly main body 304. Attachment plate 314 is a lever for lifting and lowering of assembly main body 304 as the assembly main body rotates around axel 310. In other words, lifting of the attachment plate causes lowering of the assembly main body, while lowering of the attachment plate causes lifting of the assembly main body.

The drive mechanism is configured to pivot the printer head assembly. In the present example, drive mechanism 218*b* is a pull-type electromagnetic solenoid having a retractable leg member 242 with a foot member 244 and a spring 246. An electrical cord 248 is electrically coupled to the solenoid and a power source (not shown) to provide power to the solenoid. In alternate examples, the drive mechanism can be a push-type electromagnetic solenoid. In even other alternate examples, the drive mechanism can be a cam mechanism. Further, in some examples, a position of the associated printer head assembly is detected an optical sensor (i.e., a photo-coupler senor) and the drive mechanism is operated according the position of the printer head assembly.

Figure 6:
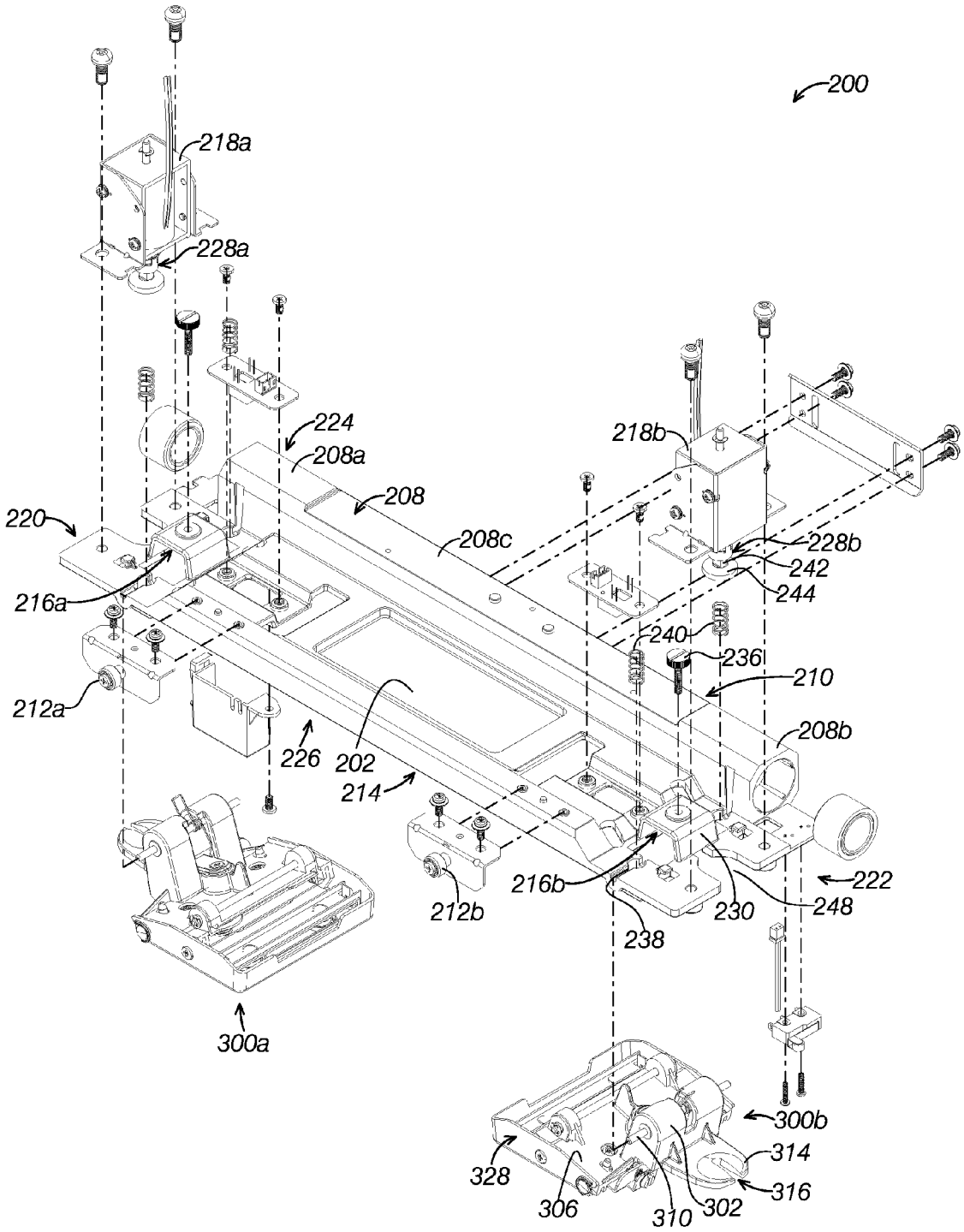
FIG. 6 is an exploded view of the first example printer head shuttle shown in FIG. 3.

As shown in FIGS. 6 and 7, foot member 244 has a greater width than leg member 242. Leg member 242 is configured to be fitted into a leg member receiving space 316 (shown in FIGS. 6 and 8) of attachment plate 314 and foot member 244 is configured to be fitted under leg member receiving space 316. Therefore, as shown in FIG. 7, a top surface of foot member 244 is abutted to a bottom surface of attachment plate 314.

Figure 11:
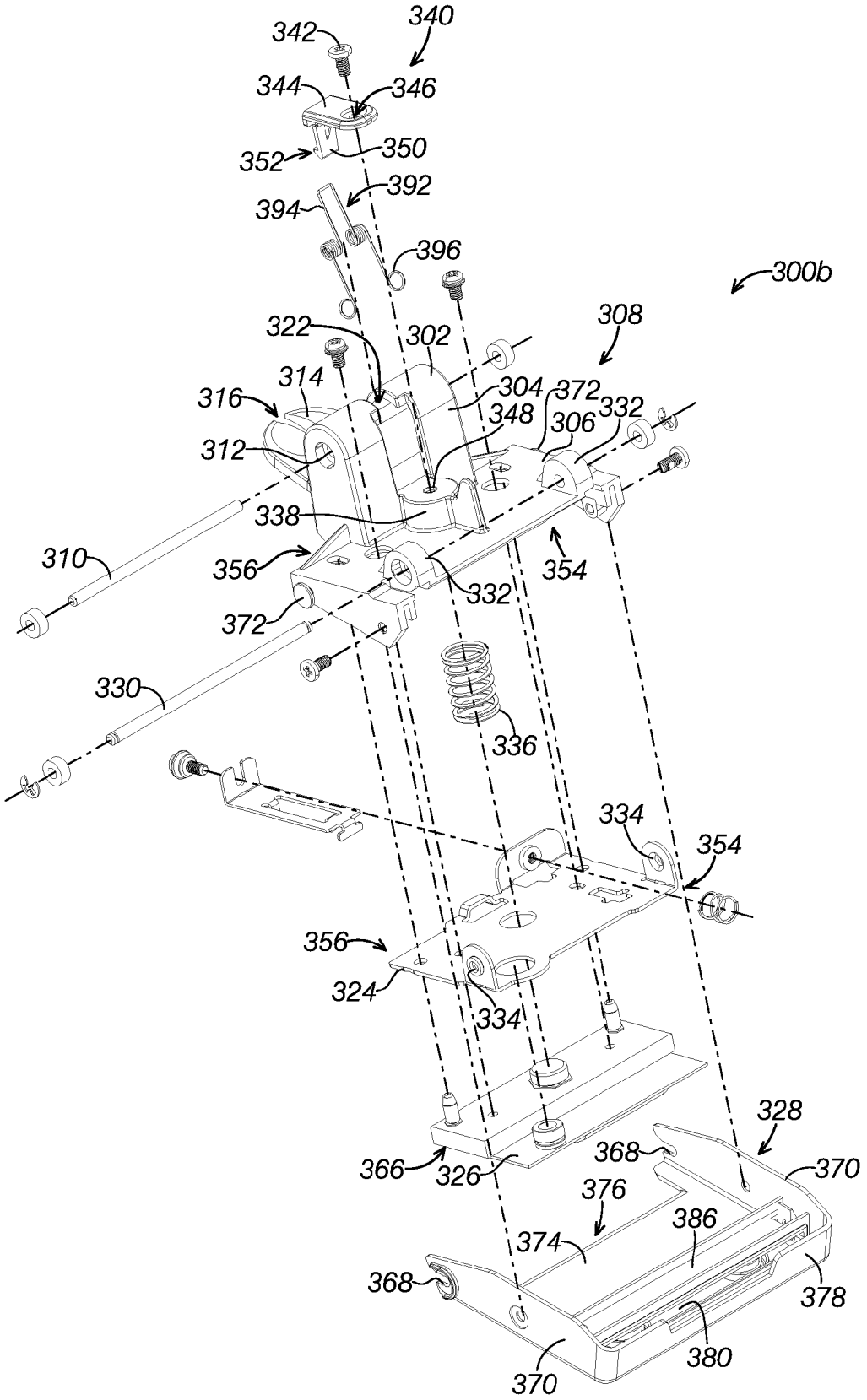
FIG. 11 is an exploded view of the first example printer head assembly shown in FIG. 7.

Spring 246 biases leg member 242 toward an extended position. Thus, the spring member biases the printer head assembly toward the substrate non-compressing position. Further, as depicted in FIG. 11, a torsion member 392 is disposed within central channel 322 and has a looped top end 394 configured to abut shuttle main body 302 and a second pronged end 396 configured to abut an inner surface (not specifically shown) of vertical wall 304. The torsion member provides a biasing force for biasing printer head assembly main body toward the substrate non-compressing position. Thus, in the present example, both spring 246 on drive mechanism 218*b* and torsion member 292 bias the assembly main body toward to the substrate non-compressing position.

In alternate examples, the printer head shuttle system and the printer head assembly can include more or fewer springs and/or other mechanisms for biasing the assembly main body towards the substrate non-compressing position. In other alternate examples, the shuttle system and/or the printer head assembly can include one or more mechanisms for biasing the assembly main body towards the substrate compressing position.

Figure 10A:
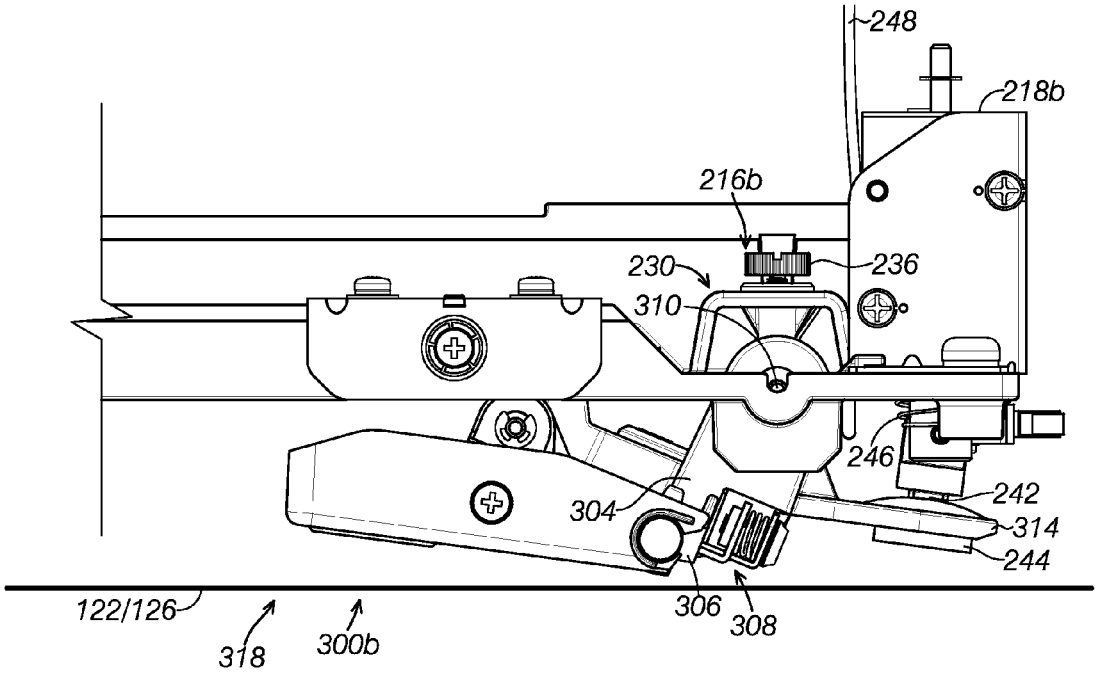
FIGS. 10A and 10B are side elevation views of the first example printer head assembly of FIG. 7 in a substrate non-compressing position and a substrate compressing position, respectively.
Figure 10B:
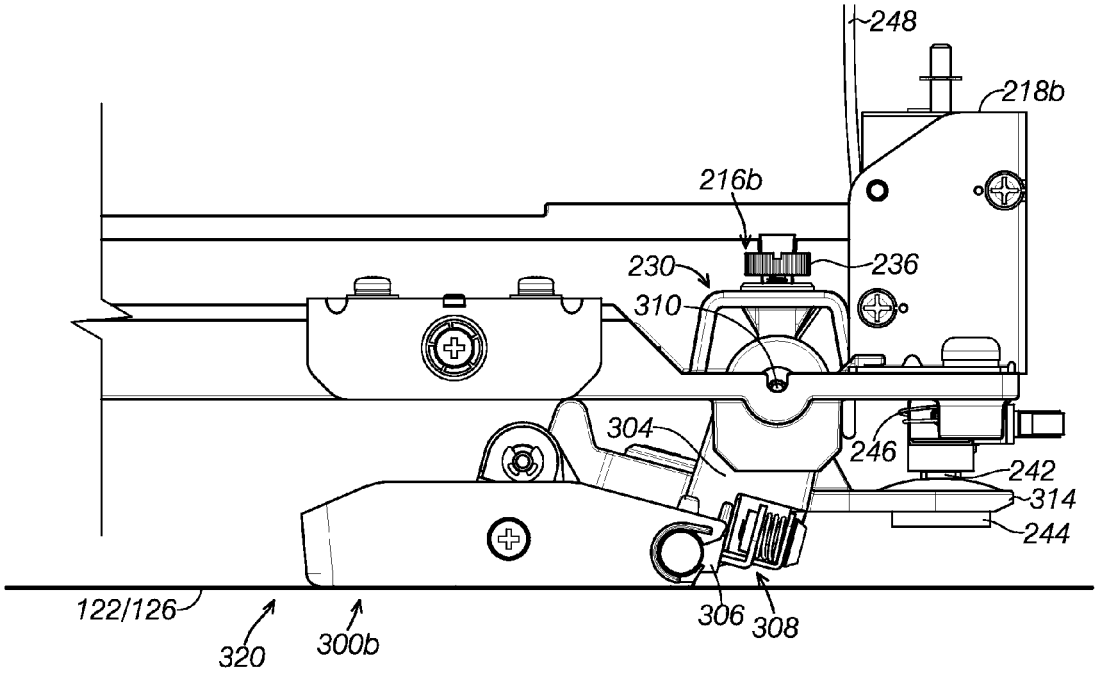

The solenoid is operatively connected to the leg member 242 to retract the leg member. Accordingly, as shown in FIGS. 10A and 10B, operation of the electromechanical solenoid drives pivot of assembly main body 300*b* between a substrate non-compressing position 318 (shown in FIG. 10A) and a substrate compressing position 320 (shown in FIG. 10B). Specifically, in substrate non-compressing position 318, leg member 242 is extended, attachment plate 314 is lowered, and assembly main body 304 is raised away from printing substrate 122. In substrate compressing position 320, leg member 242 is retracted, attachment plate 314 is raised, and assembly main body 304 is lowered toward printing substrate 122 so that printer head assembly 300*b* contacts the printing substrate and compresses it against the platen (shown in FIG. 2). In other words, in the substrate compressing position, the force of drive mechanism 218*b* retracting leg member 242 provides a first compressive force on the printing substrate.

FIG. 11 shows an exploded view of printer head assembly 300*b*. It will be appreciated that although only printer head assembly 300*b* is shown and described, printer head assembly 300*a* has a substantially identical configuration to printer head assembly 300*b*.

As described above, printer head assembly 300*b* includes assembly main body 308 comprised of horizontal plate 306 and vertical wall 304 having rounded top end 302 with a central channel 322, axel 310 laterally disposed through hole 312 in rounded top end 302 of vertical wall 304, and attachment plate 314 having leg receiving space 316. As depicted in FIG. 11, printer head assembly 300*b* further includes a printer head mounting plate 324 pivotably attached to horizontal plate 306 (i.e., pivotably attached to the assembly main body), a printer head 326 attached to printer head mounting plate 324, and a printer head cover 328 releasably attached to horizontal plate 306 (i.e., releasably attached to the assembly main body).

Printer head 326 is configured to be retained between mounting plate 324 and printer head cover 326. Printer head mounting plate 324 is pivotably attached to horizontal plate 306 via an axel 330. Axel 330 is disposed within axel receiving tabs 332, which project upwardly from horizontal plate 306, and axel receiving tabs 334, which project upwardly from mounting plate 324. Axel receiving tabs 332 and 334 are located on and/or proximal to a first side 354 of horizontal plate 306 and mounting plate 324. Thus, the mounting plate is pivotably attached to the horizontal plate at the first side.

In examples where the printer head assembly includes an optical sensor, the axel can be a "trigger bar". The trigger bar can be used to interrupt the optical sensor when the mounting and horizontal plates are moved upwards by the solenoid (i.e., the printer head assembly is in the substrate non-compressing position). As stated above, the optical sensor is configured to determine and/or detect a position of the associated printer head assembly. For example, the optical sensor can determine if the printer head assembly is in the substrate non-compressing positon or the substrate compressing position.

Returning to FIG. 11, spring 336 is disposed and retained between horizontal plate 306 and mounting plate 324. A spring housing 338 projects upwardly from horizontal plate 306 and is configured to retain spring 336. Spring 336 provides a biasing force on mounting plate 324 to pivot away from horizontal plate 306 at a second side 356. Second side 356 is an opposing side of horizontal plate 306 and mounting plate 324 relative to first side 354. Thus, the mounting plate is moveable away from the horizontal plate and biased toward the printing substrate at the second side. Spring 336 is configured so that the force applied by the solenoid can be attenuated over a range greater than the printer head assembly's tolerance.

A mounting plate stop mechanism 340 is attached to a top of spring housing 338 via an attachment member 342. More specifically, stop mechanism 340 includes a horizontal plate 344 having a hole 346 for alignment with a hole 348 on the top of spring housing 338 and insertion of fastening member 342 through the aligned holes. Stop mechanism 340 further includes a vertical wall 350 having a flange 352 that is configured to retain and/or abut mounting plate 324 on second side 356.

Figure 12A:
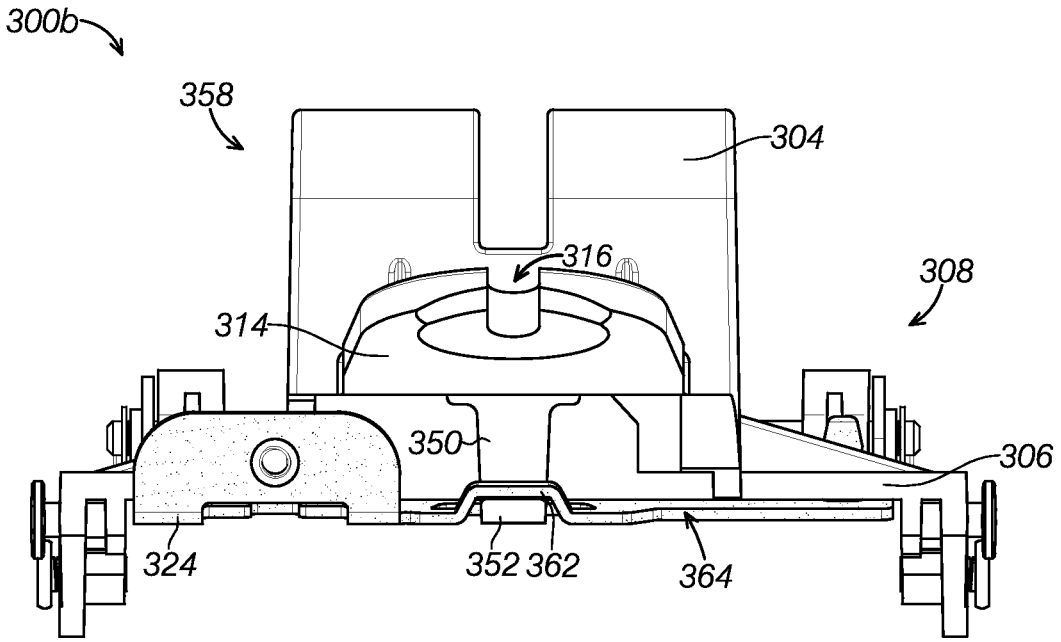
FIGS. 12A and 12B are rear elevation views of the first example printer head assembly in an open position and a closed position, respectively.
Figure 12B:
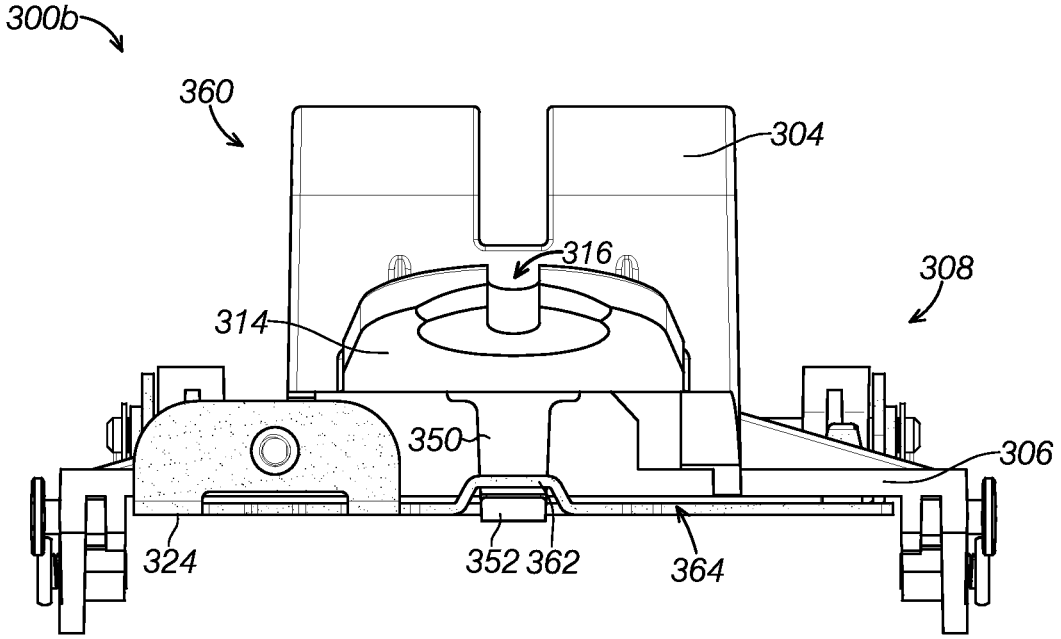

As depicted in FIGS. 12A and 12B, mounting plate 324 (at side 356) is moveable between an open position 358 and a closed position 360. As shown in FIG. 12A, in open position 358 mounting plate 324 is extended away from horizontal plate 306. Further, in open position 358, flange 352 is abutted to an upward projected lip 362 centrally located on an edge 364 of mounting plate 324. The flange prevents/stops movement of the mounting plate away from the horizontal plate of the assembly main body, even as the spring applies a biasing force on the mounting plate away from the horizontal plate.

As shown in FIG. 12B, in closed position 360, mounting plate 324 is abutted to horizontal plate 306. Further, in closed position 360, flange 352 is not abutted to upward projected lip 362. Instead, there is a space between flange 352 and upward projected lip 362. The spring is compressed into the spring housing in the closed position; therefore, a force to overcome the biasing force of the spring is required to move the mounting plate into the closed position. It will be appreciated that the mounting plate can additionally or alternatively be movable into partially closed position/partially open positions.

When the printer head assembly is in the substrate non-compressing position (i.e., the horizontal plate of the printer head assembly is rotated away from the printing substrate), the mounting plate is in the open position. When the printer head assembly is rotated into the substrate compressing position (i.e., the drive mechanism is operated to move the horizontal plate of the printer head assembly toward the printing substrate), a force is applied on the mounting plate as the mounting plate is pressed against the printing substrate and the platen. In one specific example, 0.98 kg to 1.47 kg of pressure is exerted on the printer head assembly in the substrate compressing position. Accordingly, the biasing force of the spring may be overcome or partially overcome so that the mounting plate is moved into the closed position or a partially closed position. The spring continues to press the mounting plate away from the horizontal plate. Therefore, in the substrate compressing position, the mounting plate provides a second compressing force on the printing substrate.

Returning to FIG. 11, printer head 326 includes a print transferring mechanism 366 that is proximal to the second side 356 of horizontal plate 306 and mounting plate 324. Accordingly, the second compressing force (described above) provides a compressing force at the location of the print transferring mechanism. In the present example, the printing system is a thermal printing system and the print transferring mechanism is a thermal printer cartridge head. In other examples, the printing system can be a toner-based printer with a laser printer cartridge head, a liquid inkjet printer with a liquid ink printer cartridge head, a solid ink printer with a solid ink printer cartridge head, or a dye-sublimation printer with a thermal printer cartridge head. It will be appreciated that the printing system and the printer cartridge head can be any type of printing system and printer cartridge head that is known or yet to be discovered.

Printer head cover 328 is configured to fit over printer head 326 and releasably attach to horizontal plate 306. A pair of receiving cut outs 368 in side walls 370 (i.e., one of cut outs 368 being in each side wall 370) are each configured to receive a peg 372 extended outwardly from a side of horizontal plate 306. Additionally or alternatively, the printer head cover can be attached to the horizontal plate via one or more attachment members (e.g., threaded attachment members inserted through aligned holes in sides of the cover and the mounting plate). A bottom wall 374 of cover 328 includes a window 376 that print transferring mechanism 366 extends through so that the printer transferring mechanism can contact the printing substrate (when the printer head assembly is in the substrate compressing position).

Figure 13:
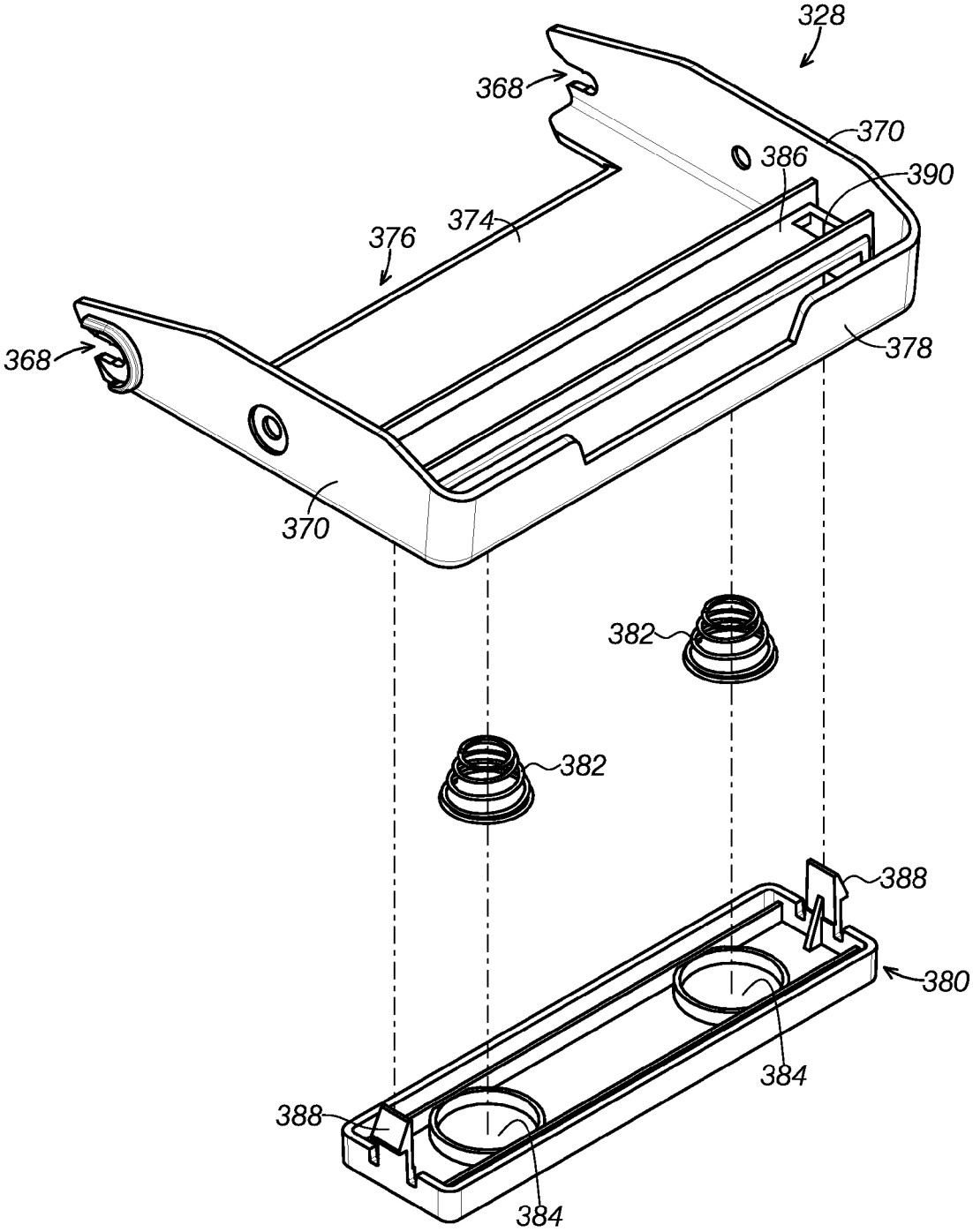
FIG. 13 is an exploded view of a first example printer head cover for the first example printer head assembly shown in FIG. 7.

FIG. 13 shows an exploded view of printer head cover 328. In the present example, the printer head cover is a printer head assembly sled comprised of a low friction material (e.g., polished PVC, aluminum, polycarbonate, ABS, etc.) and is configured to be slid over the printer substrate surface. In some examples, the printer head cover can be interchangeable with other printer head covers. In these examples, the printer head cover can be optimized for use with a specific printing substrate type to produce an optimal friction coefficient between the printer head cover and the substrate during a printing operation.

As depicted in FIG. 13, printer head cover 328 includes side walls 370 (having cutouts 368), bottom wall 374 (having window 376), a front wall 378, and a depressable body 380. Depressable body 380 is a depressable sled surface, while bottom wall 374 is a stationary sled surface. Depressable body 380 includes a pair of springs 382 that are configured to contact and be retained in a pair of spring housings 384. Specifically, one end of springs 382 contacts depressable sled body 380 and an opposing end contacts a depressable sled body housing 386 in bottom wall 374.

The depressable sled surface is on an opposing side of the printer head cover relative to the window. Further, the depressable sled surface is configured to project beyond the stationary sled surface in the substrate non-compressing position, as the springs are configured to bias the depressable sled body away from the depressable sled body housing. In the substrate compressing position, depressable sled surface is configured to contact the printing substrate and the biasing force of the springs is overcome such that the depressable sled surface is substantially flush with the stationary sled surface. Thus, the depressable sled surface is configured to provide a third compressing force on the printing substrate when the printer head assembly is in the substrate compressing position (i.e., during a printing operation). In some examples, during a printing operation, 200 g to 300 g of pressure is applied to the sled from the drive mechanism.

As stated above, it will be appreciated that although only printer head assembly 300*b* is described in detail, printer head assembly 300*a* has a substantially identical configuration. During a printing operation both printer head assemblies are driven across the printing substrate by the printer head shuttle. In one example, the printer head assemblies are alternately operated during a printing operation (i.e., duty cycle operation). In this example, power is sent to one of the printer head assemblies and it is maintained the substrate compressing positon, while power is restricted to the other printer head assembly and it is maintained in the substrate non-compressing position. Further, the first printer head assembly prints a first half of the printing substrate, and alternates printing with the second printer head assembly printing a second half of the printing substrate during the printing operation. In this example, power consumption and overheating can be reduced, and time required for printing can be reduced.

In alternate examples, both printer head assemblies can receive power and be in the substrate compressing position simultaneously. In these alternate examples, the first printer head assembly can print a first half of the printing substrate, while the second printer head assembly simultaneously prints the second half of the printing substrate. Simultaneous operation of the first and second printer head assemblies can have the advantage of even faster printing times. In other alternate examples, the printing system can include more or fewer printer head assemblies that are alternately or simultaneously operated (i.e., powered and in a substrate compressing position) during a printing operation.

In the present example, the shuttle and the printer head assemblies are comprised of aluminum. More specifically, the shuttle and the printer head assemblies can be manufactured via aluminum die-casting. In this example, the aluminum acts as a heat sink and limits overheating of the printing system. In alternate examples, one or more of the shuttle and the printer head assemblies can be comprised of machined aluminum, stamped steel, composite materials, plastics, or any other material known or yet to be discovered that is durable enough to act as a mounting structure for the various printing hardware described above. Additionally or alternatively, one or more of the shuttle and the printer head assemblies can be manufactured via casting, machine tooling, molding, and/or any other manufacturing method known or yet to be discovered.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A printer head shuttle configured to control contact pressure of at least one printer head assembly against a printing substrate and an underlying platen during a printing operation, the printer head shuttle comprising:

a shuttle guide; and a shuttle main body configured for backward and forward movement across the shuttle guide, the shuttle main body having the at least one printer head assembly, the at least one printer head assembly comprising:

an axel mounted to the shuttle main body, an assembly main body pivotably attached to the axel, a printer head mounting plate attached to the assembly main body, a printer head attached to the printer head mounting plate, and a drive mechanism, the drive mechanism configured to pivot the at least one pivotable printer head assembly between a substrate compressing position and a substrate non-compressing position, wherein, the assembly main body is configured to provide a first compressing force on the printing substrate and the underlying platen when the at least one printer head assembly is in the substrate compressing position.

2. The printer head shuttle of claim 1, wherein the printer head mounting plate is spring-biased toward a location of the printing substrate.

3. The printer head shuttle of claim 2, wherein the printer head mounting plate has a first side and a second side, and the first side is distal to a vertical wall of the assembly main body and the second side is proximal to the vertical wall of the assembly main body.

4. The printer head shuttle of claim 3, wherein a print transferring mechanism of the printer head is proximal to the second side of the printer head mounting plate, and the printer head mounting plate is configured to provide a second compressing force on the printing substrate and the underlying platen when the at least one printer head assembly is in the substrate compressing position.

5. The printer head shuttle of claim 1, further comprising a printer head cover, the printer head cover being releasably attached to the printer head assembly, the printer head configured to be retained between the printer head mounting plate and the printer head cover.

6. The printer head shuttle of claim 5, wherein the printer head cover is a printer head assembly sled comprised of a low friction material and configured to be slid over a printing substrate surface.

7. The printer head shuttle of claim 6, wherein the printer head assembly sled comprises a stationary sled surface and a window, the stationary sled surface being configured to contact the printing substrate in the substrate compressing position, a print transferring mechanism of the printer head being configured to extend through the window to contact the printing substrate in the substrate compressing position.

8. The printer head shuttle of claim 7, wherein the printer head mounting plate is spring-biased toward a location of the printing substrate and is configured to provide a second compressing force on the printing substrate and the underlying platen when the at least one printer head assembly is in the substrate compressing position, and the printer head assembly sled further comprises a depressable sled surface on an opposing end of the sled relative to the window, the depressable sled surface configured to project beyond the stationary sled surface in the substrate non-compressing position, the depressable sled surface configured to be substantially flush with the stationary sled surface in the substrate compressing position, the depressable sled surface being configured to provide a third compressing force on the printing substrate and the underlying platen when the at least one printer head assembly is in the substrate compressing position.

9. The printer head shuttle of claim 1, wherein the drive mechanism is an electromechanical solenoid mounted on an opposing side of the printer head shuttle relative to the at least one printer head assembly, the electromechanical solenoid configured to retract to pivot the at least one printer head assembly into the substrate compressing position and to extend to pivot the at least one printer head assembly into the substrate non-compressing position.

10. The printer head shuttle of claim 1, wherein the axel is mounted to the shuttle main body via an axel attachment mechanism, the axel attachment mechanism comprising a selectively tightenable set screw and two axel receiving grooves each having a spring, each of the two axel receiving grooves being configured to retain opposing ends of the axel, the set screw being configured to contact a center of the axel on an opposing side of the axel relative to the spring of each axel receiving groove, the set screw being movable between a loosened position and a tightened position.

11. The printer head shuttle of claim 10, wherein the axel is configured to be more tiltable around a longitudinal axis of the shuttle main body and an approach angle of the assembly main body is decreased when the set screw is in the loosened position, and the axel is configured to be less tiltable around the longitudinal axis of the shuttle main body and the approach angle of the assembly main body is increased when the set screw is in the tightened position.

12. The printer head shuttle of claim 1, wherein the at least one printer head assembly comprises a first printer head assembly and a second printer head assembly.

13. The printer head shuttle of claim 12, wherein the first printer head assembly and the second printer head assembly are configured to be alternately operated during a printing operation.

14. The print head cartridge shuttle of claim 1, wherein the printer cartridge head is a thermal printer cartridge head.

15. A printer head assembly configured to control contact pressure of the printer head assembly against a printing substrate and an underlying platen during a printing operation, the printer head assembly being pivotably attached to a printer head shuttle and moveable between a substrate compressing position and a substrate non-compressing position, the printer head assembly comprising:

an axel mounted to a main body of the printer head shuttle;

an assembly main body pivotably attached to the axel;

a printer head mounting plate attached to the assembly main body, the printer head mounting plate being spring-biased toward a location of the printing substrate;

a printer head releasably attached to the printer head mounting plate; and a drive mechanism, the drive mechanism configured to pivot the printer head assembly between the substrate compressing position and the substrate non-compressing position, wherein, when the printer head assembly is in the substrate compressing position, the assembly main body is configured to provide a first compressing force on the printing substrate and the underlying platen, and the printer head mounting plate is configured to provide a second compressing force on the printing substrate and the underlying platen.

16. The printer head assembly of claim 15, wherein the printer head mounting plate has a first side and a second side, the first side being distal to a vertical wall of the assembly main body and the second side being proximal to the vertical wall the assembly main body, and a print transferring mechanism of the printer head is proximal to the second side of the printer head mounting plate.

17. The printer head assembly of claim 15, further comprising a printer head assembly sled, the printer head assembly cover being releasably attached to the printer head assembly, the printer head configured to be retained between the printer head mounting plate and the printer head assembly cover, the printer head assembly cover being comprised of a low friction material and configured to be slid over a printing substrate surface during the printing operation.

18. The printer head assembly of claim 17, wherein the printer head assembly cover is a printer head assembly sled comprising a stationary sled surface, a depressable sled surface, and a window, the stationary sled surface being configured to contact the printing substrate in the substrate compressing position, a print transferring mechanism of the printer head being configured to extend through the window to contact the printing substrate in the substrate compressing position, the depressable sled surface being on an opposing end of the sled relative to the window, the depressable sled surface configured to project beyond the stationary sled surface in the substrate non-compressing position, the depressable sled surface configured to be substantially flush with the stationary sled surface in the substrate compressing position, the depressable sled surface being configured to provide a third compressing force on the printing substrate when the printer head assembly is in the substrate compressing position.

19. The printer head assembly of claim 15, wherein the drive mechanism is an electromechanical solenoid mounted on an opposing side of the printer head shuttle relative to the printer head assembly, the electromechanical solenoid configured to retract to pivot the printer head assembly into the substrate compressing position and to extend to pivot the printer head assembly into the substrate non-compressing position.

20. A printer head assembly configured to control contact pressure of the printer head assembly against a printing substrate and an underlying platen during a printing operation, the printer head assembly being pivotably attached to a printer head shuttle and moveable between a substrate compressing position and a substrate non-compressing position, the printer head assembly comprising:

an axel mounted to a main body of the printer head shuttle;

an assembly main body pivotably attached to the axel;

a printer head mounting plate attached to the assembly main body, the printer head mounting plate being spring-biased toward a location of the printing substrate, the printer head mounting plate having a first side and a second side, the first side being distal to a vertical wall of the assembly main body and the second side being proximal to the vertical wall of the assembly main body;

a printer head releasably attached to the printer head mounting plate, a print transferring mechanism of the printer head being proximal to the second side of the printer head mounting plate;

a printer head assembly sled, the printer head assembly sled being releasably attached to the printer head assembly, the printer head configured to be retained between the printer head mounting plate and the printer head assembly sled, the printer head assembly sled having a stationary sled surface, a depressable sled surface, and a window, the print transferring mechanism of the printer head being configured to extend through the window to contact the printing substrate in the substrate compressing position, the depressable sled surface being on an opposing end of the sled relative to the window, the depressable sled surface configured to project beyond the stationary sled surface in the substrate non-compressing position, the depressable sled surface configured to be substantially flush with the stationary sled surface in the substrate compressing position; and a drive mechanism, the drive mechanism configured to pivot the printer head assembly between the substrate compressing position and the substrate non-compressing position, wherein, when the printer head assembly is in the substrate compressing position, the assembly main body is configured to provide a first compressing force on the printing substrate and the underlying platen, the printer head mounting plate is configured to provide a second compressing force on the printing substrate and the underlying platen, and the depressable sled surface is configured to provide a third compressing force on the printing substrate and the underlying platen.

* * * * *